US005544397A

United States Patent [19]

Takehara

[11] Patent Number: 5,544,397

[45] Date of Patent: Aug. 13, 1996

[54] FIBER CRIMPING APPARATUS WITH MOVABLE CRIMPING MEMBER

[75] Inventor: Katsuomi Takehara, Mukou, Japan

[73] Assignee: Kabushiki Kaisha Takehara Kikai Kenkyusho, Nagaokakyo, Japan

[21] Appl. No.: 531,269

[22] Filed: Sep. 20, 1995

[30] Foreign Application Priority Data

Nov. 14, 1994 [JP] Japan ..... 6-317468

[51] Int. Cl.[6] ..... D02G 1/12

[52] U.S. Cl. ..... 28/263

[58] Field of Search ..... 28/221, 250, 251, 28/255, 256, 248, 249, 263, 264, 265, 269

[56] References Cited

U.S. PATENT DOCUMENTS

| | | | |
|---|---|---|---|
| 3,935,621 | 2/1976 | Weber . | |
| 4,908,920 | 3/1990 | Takehara | 28/263 |
| 5,319,831 | 6/1994 | Takehara | 28/263 |

FOREIGN PATENT DOCUMENTS 1408253 10/1975 United Kingdom .

*Primary Examiner*—C. D. Crowder
*Assistant Examiner*—Larry D. Worrell, Jr.
*Attorney, Agent, or Firm*—Wenderoth, Lind & Ponack

[57] ABSTRACT

A fiber crimping apparatus includes a relatively large diameter ring roller and an inscribed roller in contact with an inner surface of the ring roller. The two rollers are rotatable in the same direction at the same velocity and defined between contacting surfaces thereof a nip zone through which are to be fed bundles of fibers that are to be crimped therebetween. Each roller has thereon a respective side ring that is rotatable with the respective roller. The two rollers and two rings therefore define therebetween, at a downstream side of the nip zone, a stuffing box into which the bundles of fibers pass from the nip zone. A crimping resisting device is installed at a downstream side of the stuffing box and includes a movable member that is mounted to be movable in a widthwise direction of the stuffing box and of the bundles of fibers passing therethrough.

6 Claims, 6 Drawing Sheets

FIBER CRIMPING APPARATUS WITH MOVABLE CRIMPING MEMBER

BACKGROUND OF THE INVENTION

1. Field of the Invention

The present invention relates to a fiber crimping apparatus which has a ring roller of a comparatively large diameter and an inscribed roller which contacts an inner surface of the ring roller and which defines at a position of contact of the two rollers a nip zone.

2. Description of the Prior Art

A fiber crimping apparatus designed to form a nip zone by a ring roller and an inscribed roller is disclosed in U.S. Pat. No. 4,908,220. In such conventional fiber crimping apparatus, side rings are installed on both sides of a nip zone formed by the ring roller and the inscribed roller and rotate in the same direction at the same velocity as such two rollers. A stuffing box defined by four continuously running or rotating surfaces is formed on a downstream side of the nip zone, relative to the direction of rotation of the rollers and rings. A crimping resisting member is installed at a downstream side of the stuffing box and is mounted to be resiliently movable in the direction of bundles of fibers passing through the stuffing box. Such member thus is operable to maintain a degree of crimping of the bundles of fibers having passed through the nip zone almost uniform.

However, such known apparatus has disadvantages in that it is difficult to adjust the crimping resisting member in accordance with the changes in character, thickness and speed of processing of the fibers to be crimped, and the degree of crimping was liable to become irregular.

SUMMARY OF THE INVENTION

Therefore, an object of the present invention is to provide a fiber crimping apparatus of the above type and that performs crimping at high speed, but whereby it is easy to adjust the crimping resisting member installed at the downstream side of the stuffing box, and to improve accuracy of crimping.

Accordingly, the present invention provides a fiber crimping apparatus including a ring roller of a relatively large diameter which is rotatable in one direction, and an inscribed roller which contacts an inner surface of the ring roller and which rotates in the same direction at the same velocity as the ring roller while forming a nip zone to hold bundles of fibers to be crimped between the two rollers. Side rings are situated on opposite sides of the nip zone and are rotatable in the same direction at the same velocity as the two rollers. A stuffing box is formed on the downstream side of the nip zone, with respect to the direction of rotation, by inner surfaces of the two side rings and by contacting surfaces of the two rollers. A crimping resisting member is installed at a downstream side or end of the stuffing box and is contactable with bundles of fibers having passed through the nip zone. The crimping resisting member is mounted to be movable in the widthwise direction of bundles of fibers passing through the stuffing box.

According to the present invention, it is possible to perform minute adjustments in accordance with an increase or decrease of the bundles of fibers passing through the stuffing box and also to perform crimping smoothly because the movable crimping resisting member is resiliently supported by an air cylinder and the like in such manner as it can freely make an elastic movement in the widthwise direction of the bundles of fibers at the place of adjustment.

The apparatus has an immovable crimping resisting member at a position facing the direction of movement of the movable crimping resisting member. This arrangement has advantages that the width of change of resistance at the time of adjustment becomes smaller and a loss at the time of changing resistance decreases, compared with an apparatus having only a movable crimping resisting member.

In the fiber crimping apparatus of the present invention having the movable crimping resisting member at the downstream side of the stuffing box, the flow of the bundles of fibers is compressed or spread in its widthwise direction by the movement of the movable crimping resisting member and the degree of resistance in the stuffing box can be adjusted. As a result, the adjustment of the degree of crimping becomes variable, and the motion of the crimping resisting member becomes very precise. Also, the adjusting operation is easy, and it is possible to maintain the degree of resistance in the stuffing box almost uniform.

BRIEF DESCRIPTION OF THE DRAWINGS

The accompanying drawings show embodiments of the present invention.

DETAILED DESCRIPTION OF THE PREFERRED EMBODIMENT

Embodiments of the device according to the invention are explained below with reference to FIGS. 1–6 of the attached drawings.

Figure 1:
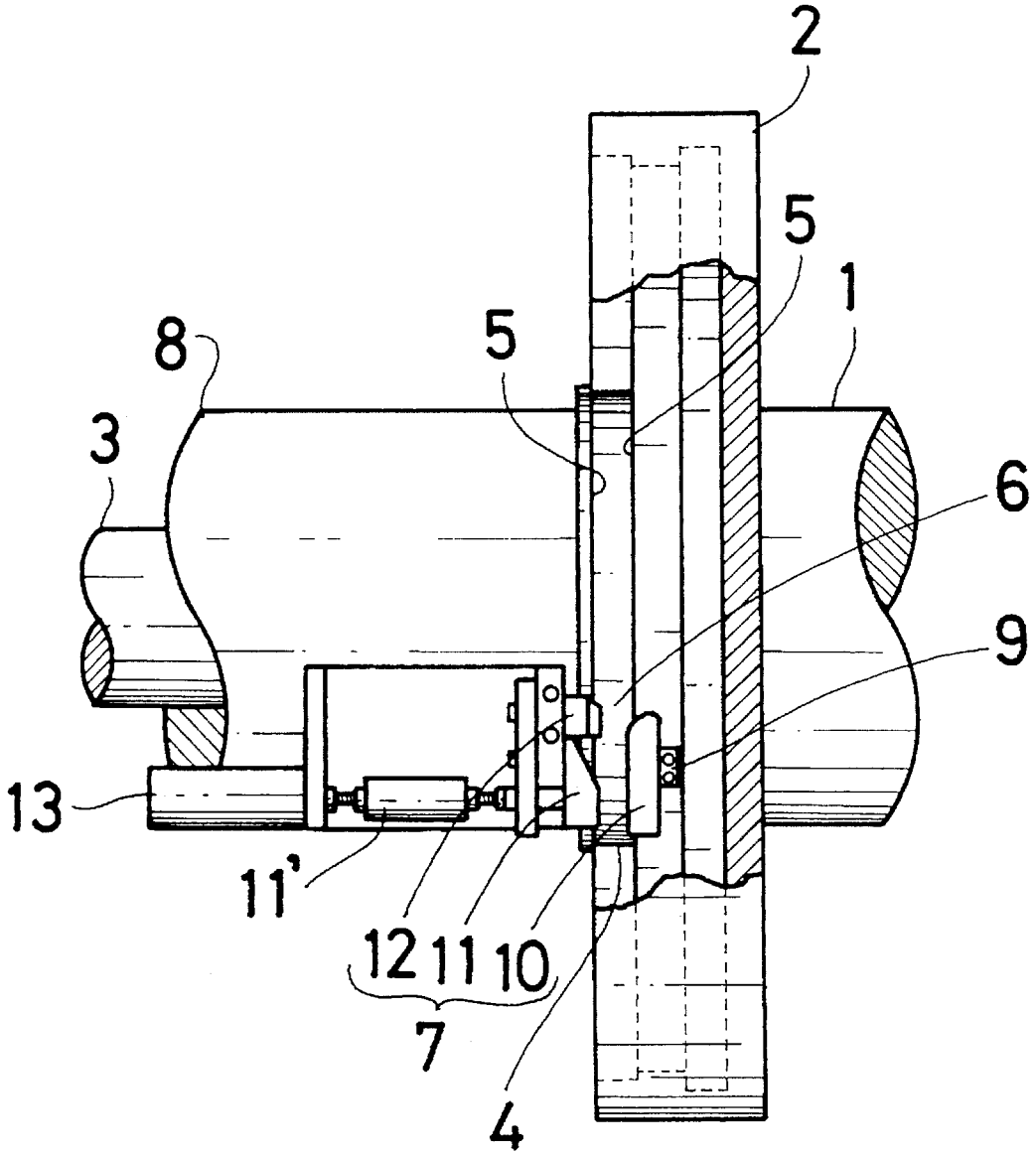
FIG. 1 is a partial elevation view of important elements of one embodiment of the present invention.

As shown in FIG. 1, a fiber crimping apparatus of the present invention includes a ring roller 2 of a large diameter fixed at an end of a rotary shaft 1, and an inscribed roller 4 which is installed at an end of another rotary shaft 3 facing rotary shaft i in such manner that roller 4 contacts an inner circumference of ring roller 2. The ring roller 2 and the inscribed roller 4 rotate at their place of contact respectively together with the rotary shaft 1 and the rotary shaft 3 in a body in the same direction at the same velocity. Rollers 1 and 3 form a nip zone to nip bundles of fibers at their place of contact and upstream and downstream of such nip zone, relative to the direction of rotation. Further, the nip zone is delimited at opposite sides thereof by respective side rings that are installed integrally on the ring roller 2 and the inscribed roller 4. A stuffing box 6 is defined downstream or behind the nip zone, relative to the rotating direction, in such manner that outer and inner radial surfaces of the stuffing box are enclosed by the inner circumference of the ring roller 2 and the outer circumference of the inscribed roller 4, respectively, and right and left opposite axial sides of the stuffing box are also enclosed by inner surfaces of the right and left side rings.

Bundles of fibers to be crimped are fed between the ring roller 2 and the inscribed roller 4. Such bundles of fibers are regulated in their widthwise direction between the right and left side rings 5 in the nip zone centering on the position of contact between the two rollers 2, 4, and are compressed in their thickness direction, and they are passed into the stuffing box 6.

Figure 2:
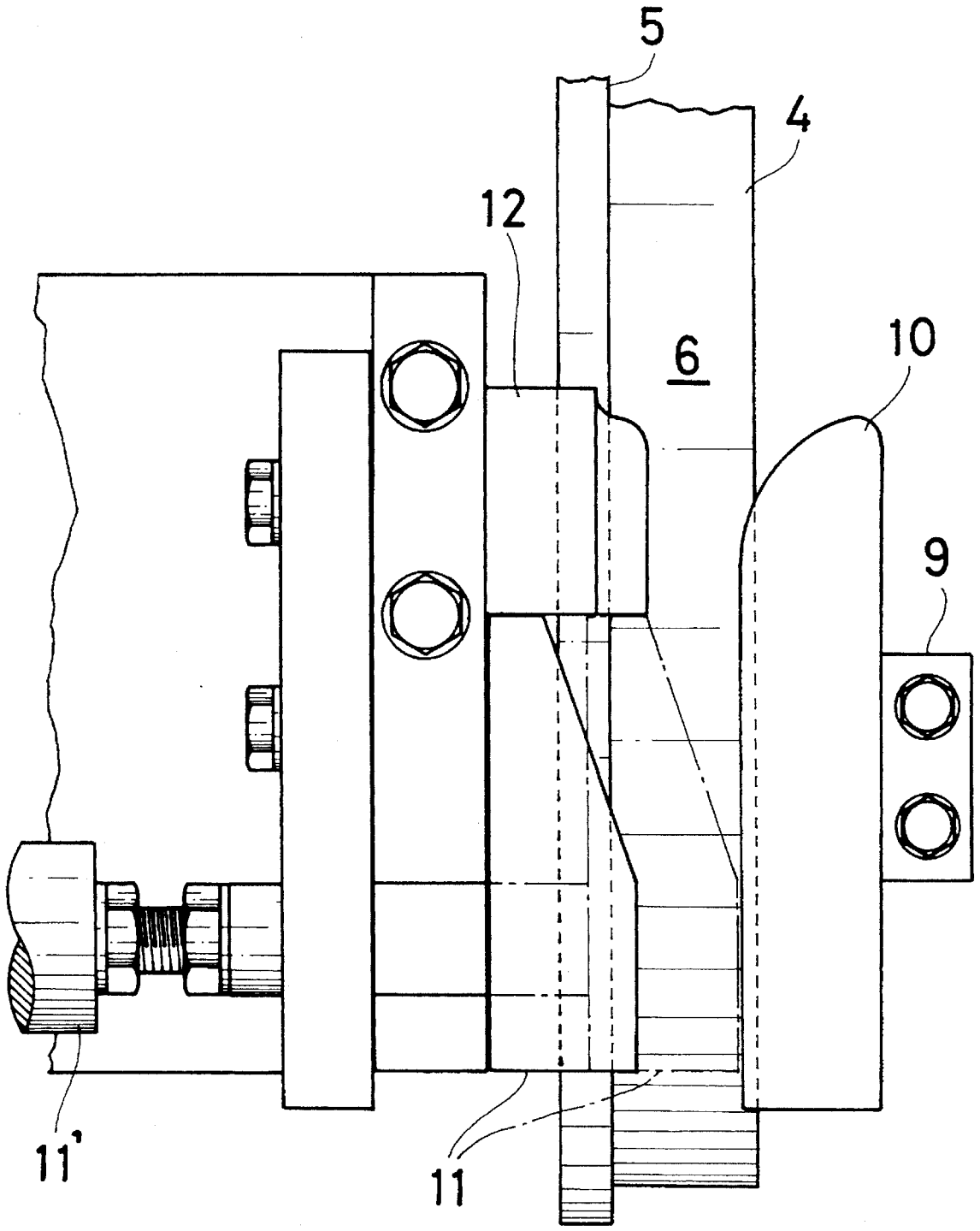
FIG. 2 is an enlarged elevation view of a crimping resisting device in FIG. 1.

A crimping resisting device 7 composed as shown in FIG. 2 is installed at the rear or downstream portion of the stuffing box 6. Crimping resisting device 7 includes an immovable crimping resisting member 10 fixed on attachment 9 extended from a frame (which is not shown in the drawings), and a movable crimping resisting member 11 which is installed to face member 10 across the axial or widthwise direction of stuffing box 6.

In the embodiment as shown in FIGS. 1 and 2, movable crimping resisting member 11 is movable to pass transversely through a rear or downstream part of another immovable crimping resisting member 12 which is positioned to face or confront immovable crimping resisting member 10. Movable member 11 thus can be moved freely in the same direction as the widthwise direction of the bundles of fibers, i.e. axially. A base 11' of movable crimping resisting member 11 is supported by an air cylinder 13 installed on a side of a bearing member 8 in such manner slide freely, and expands and contacts in accordance with pressure control by air cylinder 13. Base 11' supports the movable crimping resisting member 11. Therefore, when the pressure in the air cylinder 13 increases, the degree of crimping in the pathway of the bundles of fibers in the stuffing box 6 is increased, while when the pressure decreases the degree of crimping is decreased.

Figure 3:
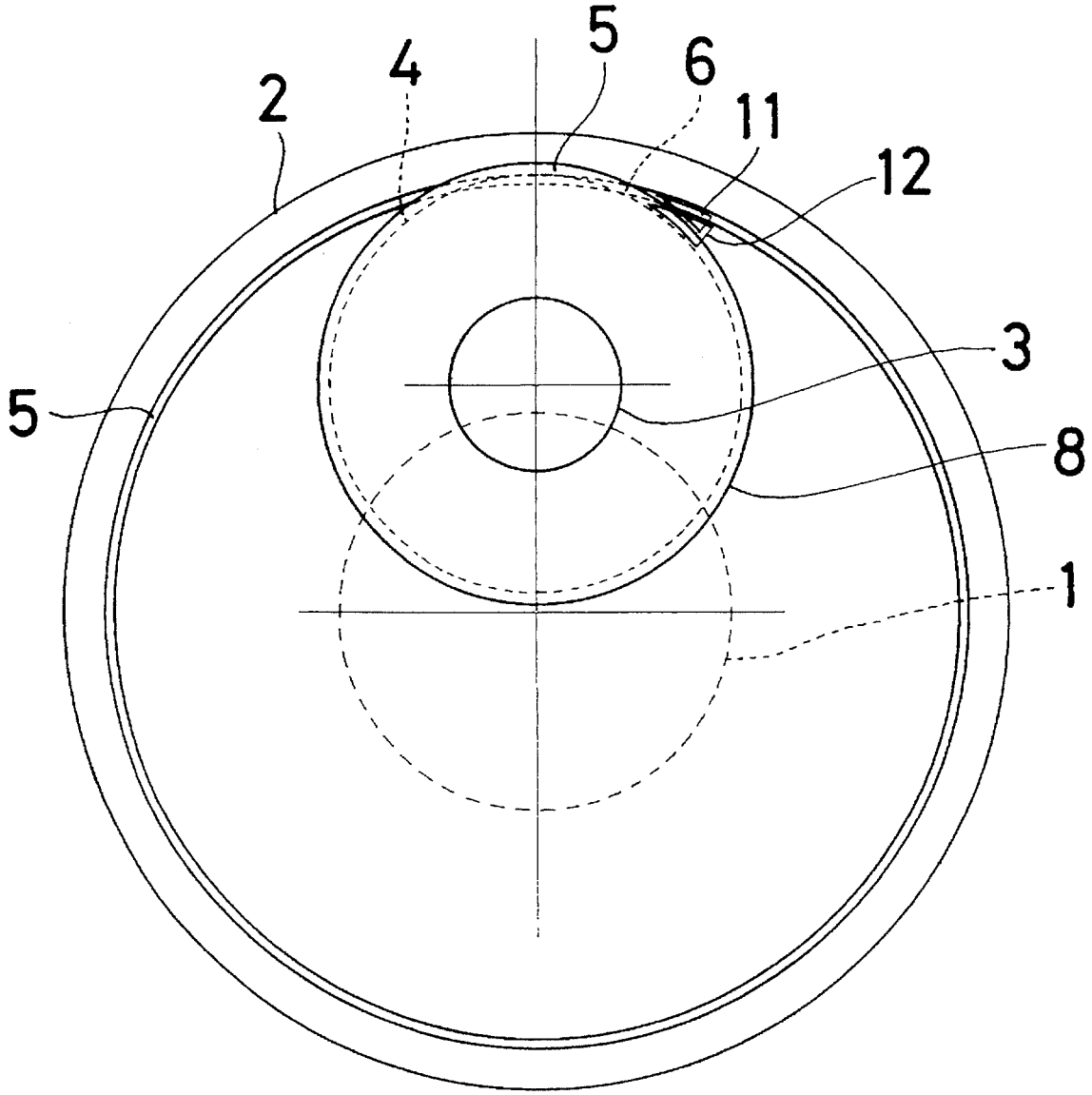
FIG. 3 is a partial side view of the apparatus.

FIG. 3 illustrates the arrangement of the stuffing box 6, the immovable crimping resisting member 12 and the movable crimping resisting member 11. FIG. 3 shows the side of the stuffing box 6 that diverges from the nip zone as the surface of the inscribed roller 4 forming the nip zone leaves the inner circumference of the ring roller 2. The immovable crimping resisting member 12 is relatively inwardly or below, while the movable crimping resisting member 11 is situated relatively outwardly or above. These crimping resisting members 12, 11 contact the bundles of fibers that are waved vertically in the stuffing box 6 after having passed through the nip zone, and control the flow of the bundles of fibers. The bundles thus are compressed both in the widthwise direction thereof and in the thicknesswise direction thereof. Formation of crimping thereby is promoted.

Figure 4:
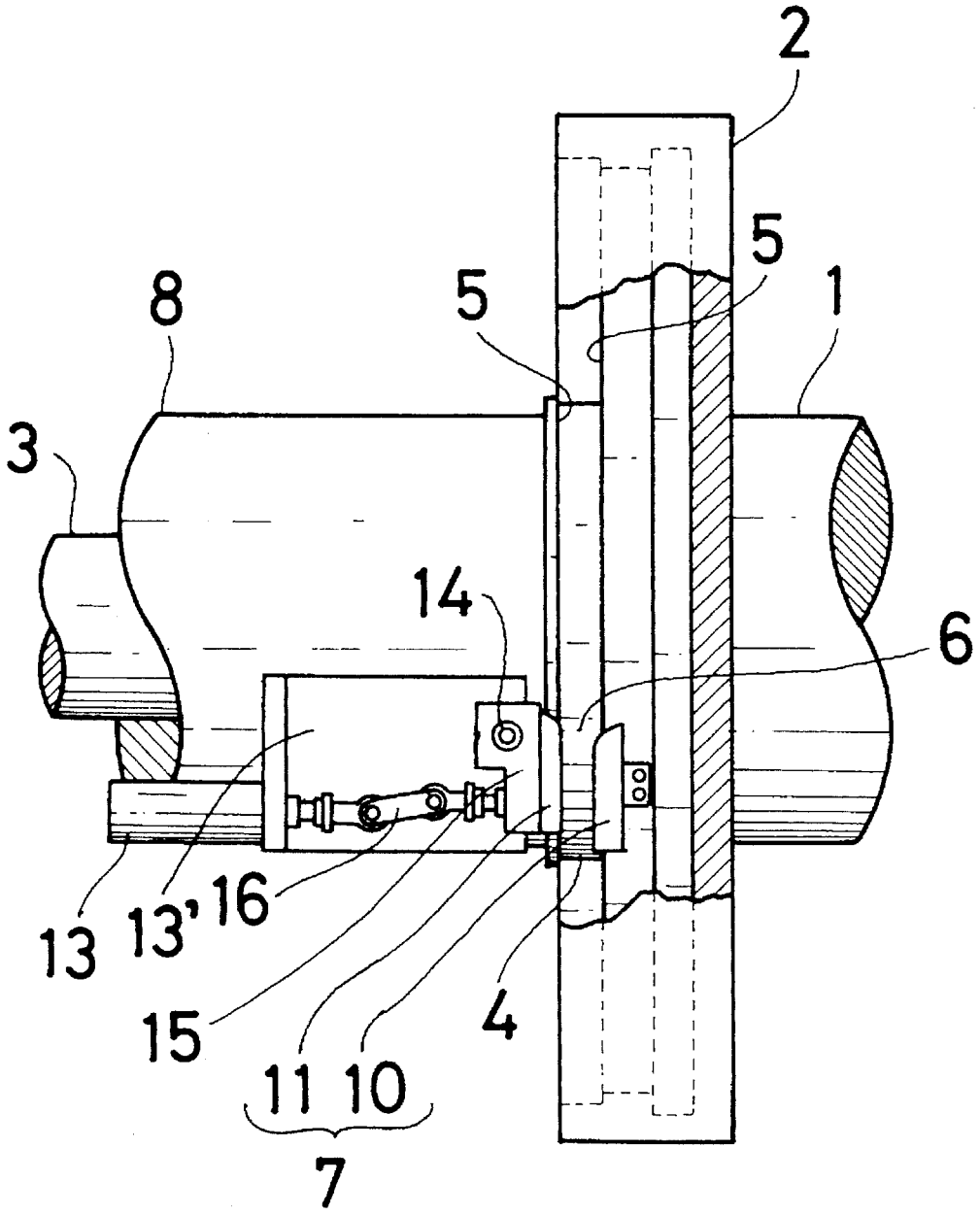
FIG. 4 is a view similar to FIG. 1 of a modified embodiment.
Figure 5:
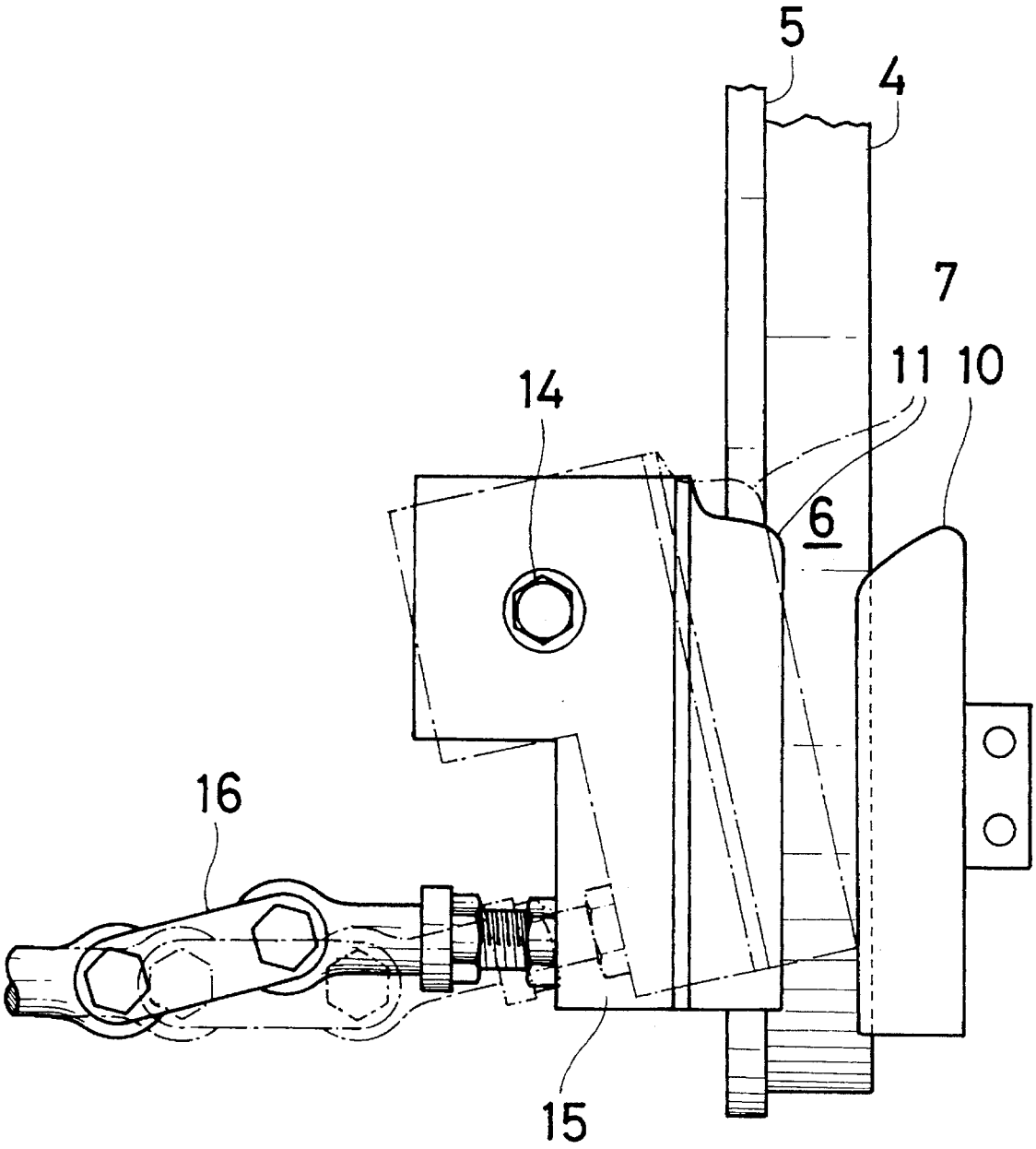
FIG. 5 is an enlarged view of a crimping resisting device of FIG. 4.
Figure 6:
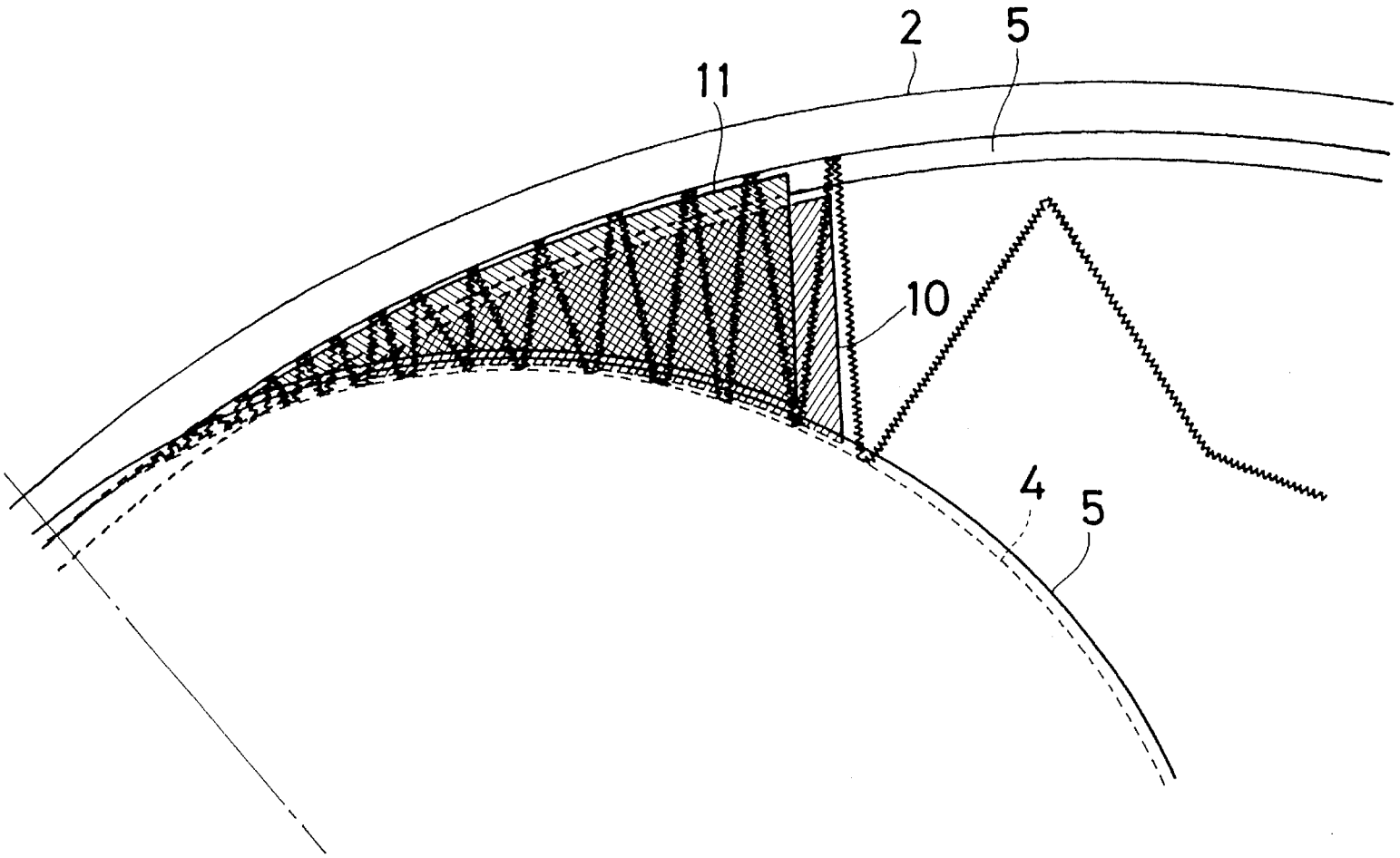
FIG. 6 is a schematic view illustrating how crimps are formed in a stuffing box.

The movement of movable crimping resisting member 11 may be carried out by swinging motion as shown in the embodiment of FIGS. 4 and 5. A bracket 15 is connected to pivot relative to a base 13' of air cylinder 13, fixed to bearing member 8, about a pivot shaft 14. Bracket 15 is integrally connected to the movable crimping resisting member 11, while the bracket 15 and the air cylinder 13 are connected by a sliding flexible coupling 16. The movable crimping resisting member 11 pivots relative to a side of the stuffing box 6 in accordance with the increase and decrease of pressure in the air cylinder 13, and thereby controls the bundles of fibers in their widthwise direction.

The movement of the movable crimping resisting member 11 may be adjusted by the spring pressure of a coil spring or the like, rather than the air cylinder 13. Further, the movable crimping resisting member 11 need not always be supported elastically by the air cylinder 13 or the spring, but rather may be fixed to a moving means that can advance or retreat, e.g. a screw.

According to the present invention which, as described above, the movable crimping resisting member is provided at the rear of the stuffing box formed by the ring roller, the inscribed roller and the right and left side rings and controls the pathway of the bundles of fibers passing through the stuffing box in their widthwise direction. Thus, the apparatus of the invention can quickly cope with the changes in character, thickness, amount and crimping degree of chemical fibers to be crimped. Further, adjustment is easy, fiber crimping with little unevenness in process accuracy can be obtained.

We claim:

1. A fiber crimping apparatus comprising:

a ring roller of a large diameter and rotatable in one direction;

an inscribed roller rotatable in the same direction at the same velocity as said ring roller and in contact with an inner surface thereof, thus forming a nip zone for bundles of fibers to be crimped thereat between said rollers;

side rings of respective said rollers at opposite sides of said nip zone, said side rings being rotatable in the same direction at the same velocity as said rollers;

a stuffing box defined at a downstream side of said nip zone, relative to the direction of rotation, by continuously rotatable inner surfaces of said side rings and contacting surfaces of said rollers; and a crimping resisting device installed at a downstream side of said stuffing box, relative to the direction of rotation, to contact the bundles of fibers having passed through said nip zone, said device including a movable crimping resisting member mounted for movement in a widthwise direction of said stuffing box and of bundles of fibers passing therethrough.

2. A fiber crimping apparatus as claimed in claim 1, wherein said movable crimping resisting member is resiliently movable in said widthwise direction.

3. A fiber crimping apparatus as claimed in claim 1, wherein said device further includes an immovable crimping resisting member installed at a position confronting said movable member and with said movable member being movable toward and away from said immovable member.

4. A fiber crimping apparatus as claimed in claim 3, wherein said device further includes another immovable crimping resisting member installed at a position confronting said immovable member across said stuffing box.

5. A fiber crimping apparatus as claimed in claim 1, further comprising means for moving said movable member in said widthwise direction.

6. A fiber crimping apparatus as claimed in claim 1, wherein said movable member is mounted to be pivotally movable in said widthwise direction.

* * * * *